US006332383B1

(12) United States Patent
Komatsu

(10) Patent No.: US 6,332,383 B1
(45) Date of Patent: Dec. 25, 2001

(54) FASTENING TORQUE CONTROL TOOL IN FASTENING DEVICE

(75) Inventor: Kazuo Komatsu, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/631,790

(22) Filed: Aug. 3, 2000

(30) Foreign Application Priority Data

Aug. 17, 1999 (JP) ..... 11-230545

(51) Int. Cl.[7] ..... B25B 23/153
(52) U.S. Cl. ..... 81/471; 81/468
(58) Field of Search ..... 81/471, 477, 468

(56) References Cited

U.S. PATENT DOCUMENTS 2,544,522 * 3/1951 Bertelsen ..... 81/471
2,740,315 * 4/1956 Gouverneur ..... 81/471
3,191,486 * 6/1965 Gibbens ..... 81/471
3,331,267 * 7/1967 Tietgeq ..... 81/471
3,555,938 * 1/1971 Busch, Jr. ..... 81/477
3,667,327 * 6/1972 Lance ..... 81/468
3,709,087 * 1/1973 Stone, Jr. ..... 81/477
3,830,119 * 8/1974 Travis ..... 81/477
4,037,515 * 7/1977 Kesselman ..... 85/61
4,215,600 * 8/1980 Kesselman ..... 81/471
5,176,050 * 1/1993 Sauer et al. ..... 81/471
5,390,573 * 2/1995 Mann ..... 81/468
6,112,626 * 9/2000 Risner et al. ..... 81/468

* cited by examiner

*Primary Examiner*—James G. Smith
*Assistant Examiner*—Hadi Shakeri
(74) *Attorney, Agent, or Firm*—Foley & Lardner

(57) ABSTRACT

The fastening torque control tool for a fastening device herein includes a base portion which is fixed onto a head portion of the fastening device in a way that restricts relative rotation around the device's axis. The tool has an operational portion which is integrally provided with the base portion on the same axis. The operational portion is fixed into a fastening instrument to turn the fastening device in a way that restricts relative rotation around the axis. The control tool also contains a separating portion for separating the operational portion from the base portion when a fastening torque, which is applied to the operational portion, reaches a predetermined level. The separating portion is formed between the base portion and the operational portion.

4 Claims, 5 Drawing Sheets

FASTENING TORQUE CONTROL TOOL IN FASTENING DEVICE

BACKGROUNDS OF THE INVENTION

1. Field of the Invention

The present invention relates to a fastening torque control tool of a fastening device for making constant the fastening torque by a fastening material, that is the joint strength, in fastening by use of the fastening material such as a bolt or a screw.

2. Description of the Related Art

As illustrated in FIG. 5 and FIG. 6, for example, in a case 3 consisting of a top box 1 and a bottom box 2 coming into contact with the top box 1, the top box 1 is connected to the bottom box 2 by a plurality of bolts 4 which act as fastening devices and which extend through the top box 1, in the conventional technique.

In these drawings, a concave portion 5 is formed on the top surface of the top box 1, and a through hole 6 of a smaller diameter than that of the concave portion 5 is formed continued from the concave portion 5. A tapped hole 7 positioned along the same axis as that of the through hole 6 is formed on the inside of the bottom box 2. After bringing the bottom box 2 into contact with the top box 1, the bolt 4 as the fastening device is inserted into the concave portion 5 and the through hole 6. The bolt 4 is screwed down into the tapped hole 7 of the bottom box 2, thereby connecting both boxes 1 and 2.

The bolt 4, that is, for example, a hexagon socket head cap screw, is screwed by a hexagonal wrench 8 as a fastening instrument.

This fastening method requires management of the fastening torque, in some cases, in order to prevent the occurrence of disadvantages such as looseness after fastening. Management of the fastening torque is also required to make the fastening forces of a plurality of fastening devices uniform.

The above-mentioned torque control is performed by using a tool provided with a torque control function, such as a torque wrench, in the manufacturing line or the assembly line of a factory.

Under present conditions, however, at the assembly time or maintenance time in the site, the above-mentioned tool provided with the torque control function is rarely used. The torque control cannot help relying on the sense of a worker, and the constant fastening torque cannot be always obtained.

Even if fastening can occur with the tool provided with the torque control function in the factory, there is a possibility that the fastening will be performed by a torque other than the established torque. Moreover, once it is fastened, it is impossible to confirm the fastening torque.

SUMMARY OF THE INVENTION

To solve the conventional problem, an object of the present invention is to provide a fastening torque control tool of a fastening device capable of confirming the fastening torque of the fastening device that has been fastened, regardless of whether the fastening occurs at the factory or at the site.

According to one aspect of the invention, a fastening torque control tool of a fastening device comprises a base portion fixed into a head portion of the fastening device in a way of restricting relative rotation around its axis, and an operational portion, integrally provided with the base portion on the same axis, which a fastening instrument to turn the fastening device is fixed into in a way of restricting relative rotation around the axis, wherein a separating portion for separating the operational portion from the base portion when a fastening torque applied to the operational portion reaches a predetermined value is formed between the base portion and the operational portion.

In the preferred construction, the separating portion is formed by making thin a connected portion of the operational portion and the base portion as a thin portion.

In another preferred construction, the separating portion is formed by making thin a connected portion of the operational portion and the base portion as a thin portion, and the thin portion is formed on the whole circumference of the operational portion.

In another preferred construction, the separating portion is formed by making thin a connected portion of the operational portion and the base portion as a thin portion, and the thin portion is formed at a plurality of positions at predetermined intervals in the circumferential direction of the operational portion.

In another preferred construction, the base portion is formed so as to be attached to the head portion of the fastening device in a state of the operational portion being separated.

In another preferred construction, the base portion is formed so as to be attached to the head portion of the fastening device in a state of the operational portion being separated, and the separating portion is formed by making thin a connected portion of the operational portion and the base portion as a thin portion.

In another preferred construction, the base portion is formed so as to be attached to the head portion of the fastening device in a state of the operational portion being separated, the separating portion is formed by making thin a connected portion of the operational portion and the base portion as a thin portion, and the thin portion is formed on the whole circumference of the operational portion.

In another preferred construction, the base portion is formed so as to be attached to the head of the fastening device by being fixed into the head of the fastening device in a pressed state, when the operational portion is separated.

In another preferred construction, the base portion is formed so as to be attached to the head of the fastening device by being fixed into the head of the fastening device in a pressed state, when the operational portion is separated, and the separating portion is formed by making thin a connected portion of the operational portion and the base portion as a thin portion.

In another preferred construction, the base portion is formed so as to be attached to the head portion of the fastening device by an adhesive agent applied to a connected portion of the base portion with the head portion of the fastening device and, in a state of the operational portion being separated.

In another preferred construction, the base portion is provided with a marking function for marking the fastening device when the base portion is fixed into the fastening device.

In another preferred construction, the base portion is provided with a marking function for marking the fastening device when the base portion is fixed into the fastening device, and the separating portion is formed by making thin a connected portion of the operational portion and the base portion as a thin portion.

In another preferred construction, the base portion is provided with a marking function for marking the fastening device when the base portion is fixed into the fastening device, and the base portion is formed so as to be attached to the head portion of the fastening device in a state of the operational portion being separated.

In another preferred construction, the base portion is provided with a marking function for marking the fastening device when the base portion is fixed into the fastening device, and the marking function is executed by applying colorant on the connected surface of the base portion with the fastening device and attaching the colorant to the head of the fastening device when the base portion is fixed into the head of the fastening device.

In another preferred construction, the head of the fastening device is a hexagonal pole, and a hexagonal socket to fix the head therein is formed on the base portion of the fastening torque control tool.

In another preferred construction, the head of the fastening device is a hexagonal pole, and a hexagonal socket to fix the head therein is formed on the base portion of the fastening torque control tool, and the separating portion is formed by making thin a connected portion of the operational portion and the base portion as a thin portion.

In another preferred construction, the head of the fastening device is a hexagonal pole, and a hexagonal socket to fix the head therein is formed on the base portion of the fastening torque control tool, and the base portion is formed so as to be attached to the head portion of the fastening device in a state of the operational portion being separated.

In another preferred construction, the head of the fastening device is a hexagonal pole, and a hexagonal socket to fix the head therein is formed on the base portion of the fastening torque control tool, and the fastening instrument is a hexagonal wrench, and a hexagonal socket to fix the fastening instrument therein is formed on the operational portion of the fastening torque control tool.

In another preferred construction, the head of the fastening device is a hexagonal pole, and a hexagonal socket to fix the head therein is formed on the base portion of the fastening torque control tool, the fastening instrument is a hexagonal wrench, and a hexagonal socket to fix the fastening instrument therein is formed on the operational portion of the fastening torque control tool, and the separating portion is formed by making thin a connected portion of the operational portion and the base portion as a thin portion.

Also, the head of the fastening device is a hexagonal pole, and a hexagonal socket to fix the head therein is formed on the base portion of the fastening torque control tool, the fastening instrument is a hexagonal wrench, and a hexagonal socket to fix the fastening instrument therein is formed on the operational portion of the fastening torque control tool, the separating portion is formed by making thin a connected portion of the operational portion and the base portion as a thin portion, and the base portion is formed so as to be attached to the head portion of the fastening device in a state of the operational portion being separated.

Other objects, features and advantages of the present invention will become clear from the detailed description given herebelow.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENT

The preferred embodiment of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to prevent any unnecessary obscuring of the present invention.

Figure 1:
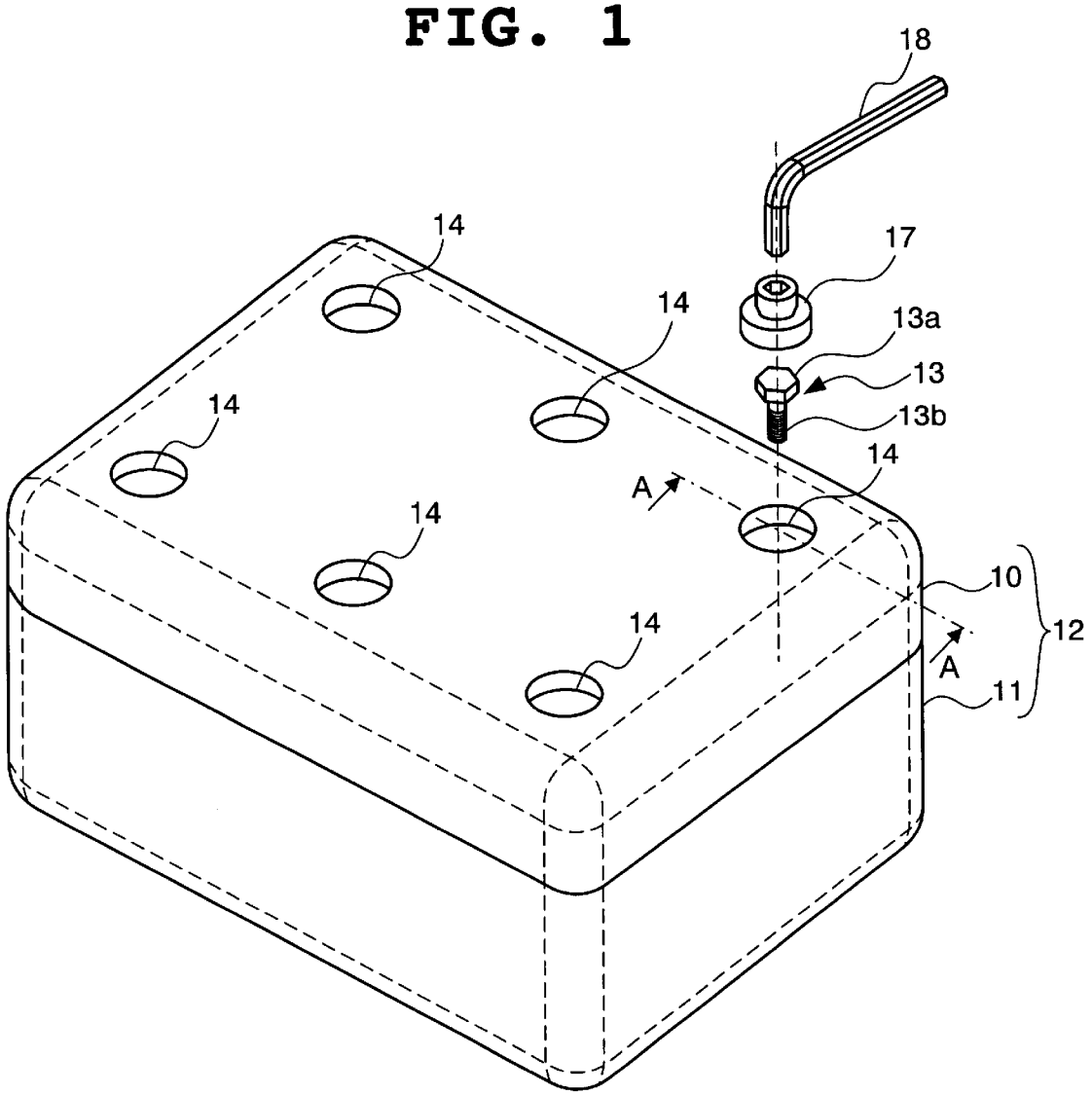
FIG. 1 is an exploded perspective view showing the fastening structure of a case according to one embodiment of the present invention.

As illustrated in FIG. 1, this embodiment will be described while applying the present invention to a case 12 consisting of a top box 10 and a bottom box 11 which is fastened to the top box 10 by using a plurality of hexagonal bolts 13 acting as fastening devices.

Figure 2:
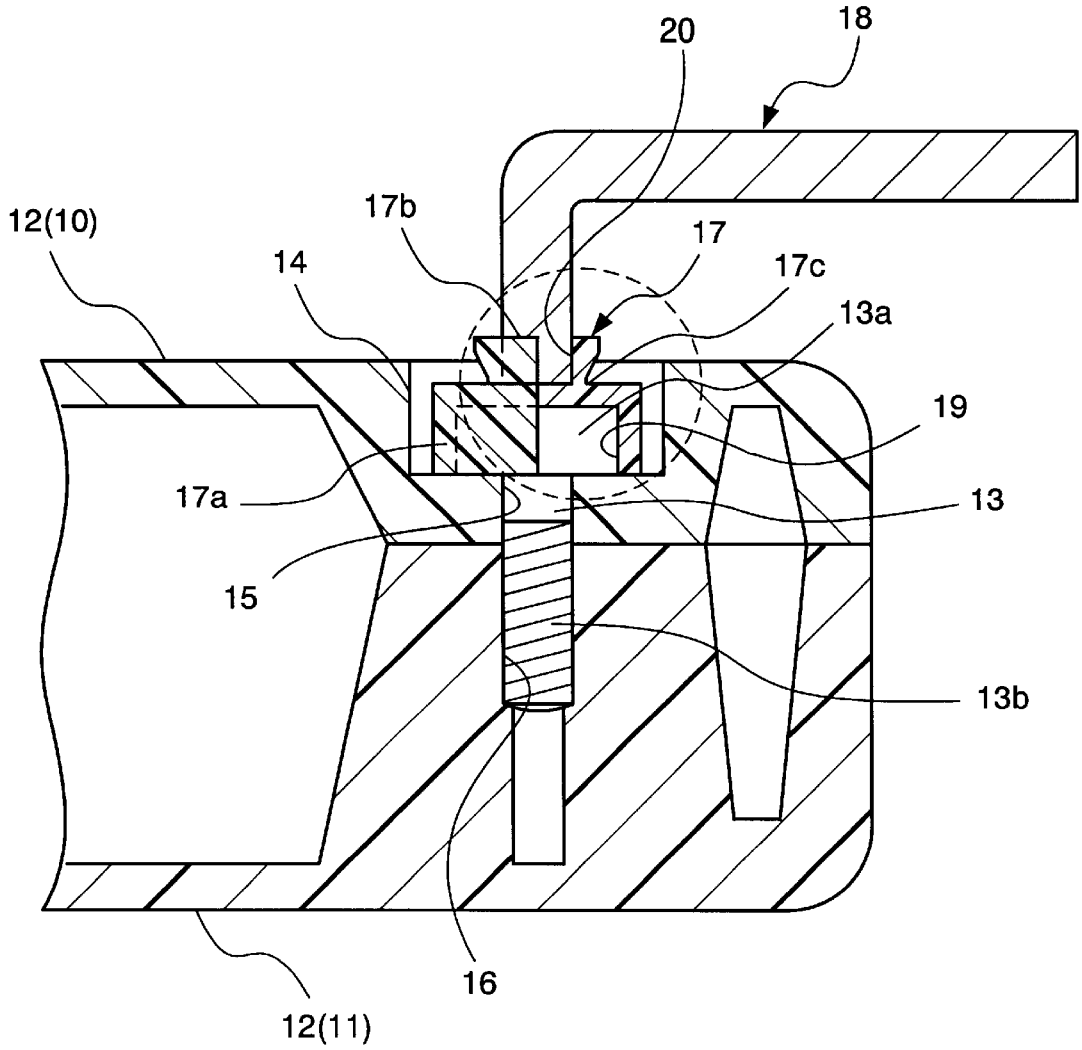
FIG. 2 is a cross-sectional view of an important portion showing the fastening structure of a case according to one embodiment of the present invention.

A plurality of concave portions 14, receiving each head portion 13*a* of each bolt 13 therein, are formed on the top box 10 of the case 12. As illustrated in FIG. 2, a through hole 15, for inserting a screw portion 13*b* of the bolt 13 therein, is formed continued from the concave portions 14.

A tapped hole 16, for inserting the screw portion 13*b* of the bolt 13 after it is inserted into the through hole 15 of the top box 10, is formed at a portion of the bottom box 11 corresponding to the concave portion 14 of the top box 10.

A fastening torque control tool 17 related to the embodiment is installed on the head of the bolt 13.

Figure 4:
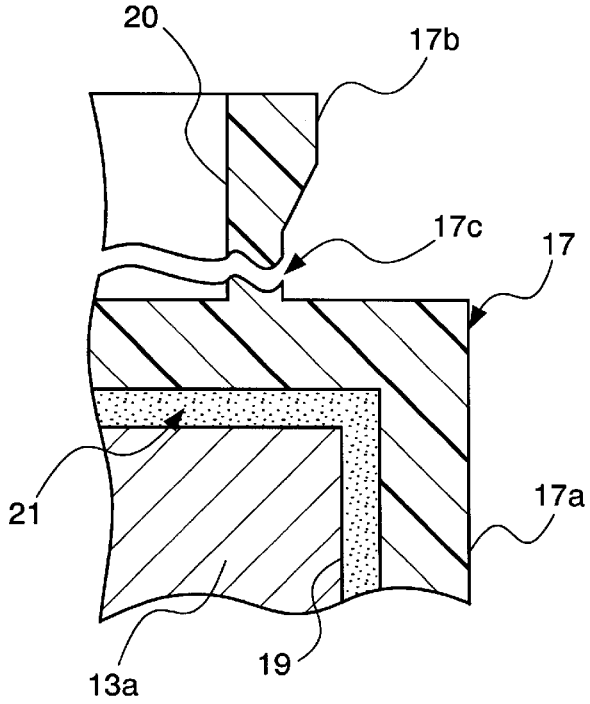
FIG. 4 is a cross-sectional view showing the fastening structure of a case in the state after fastening, with one portion omitted therefrom, according to one embodiment of the present invention.
Figure 5:
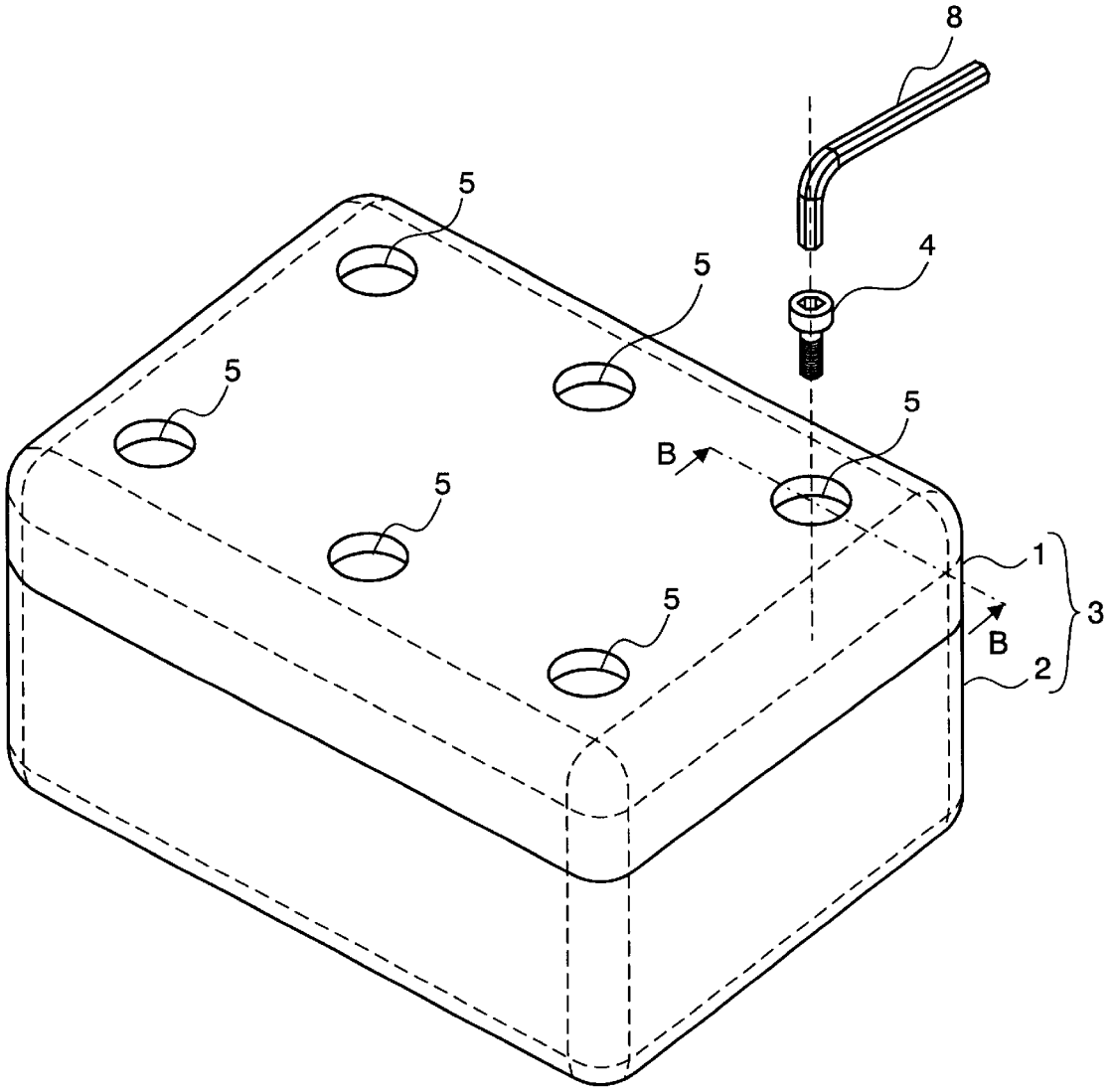
FIG. 5 (PRIOR ART)
FIG. 5 is an exploded perspective view showing the fastening structure of the conventional case.
Figure 6:
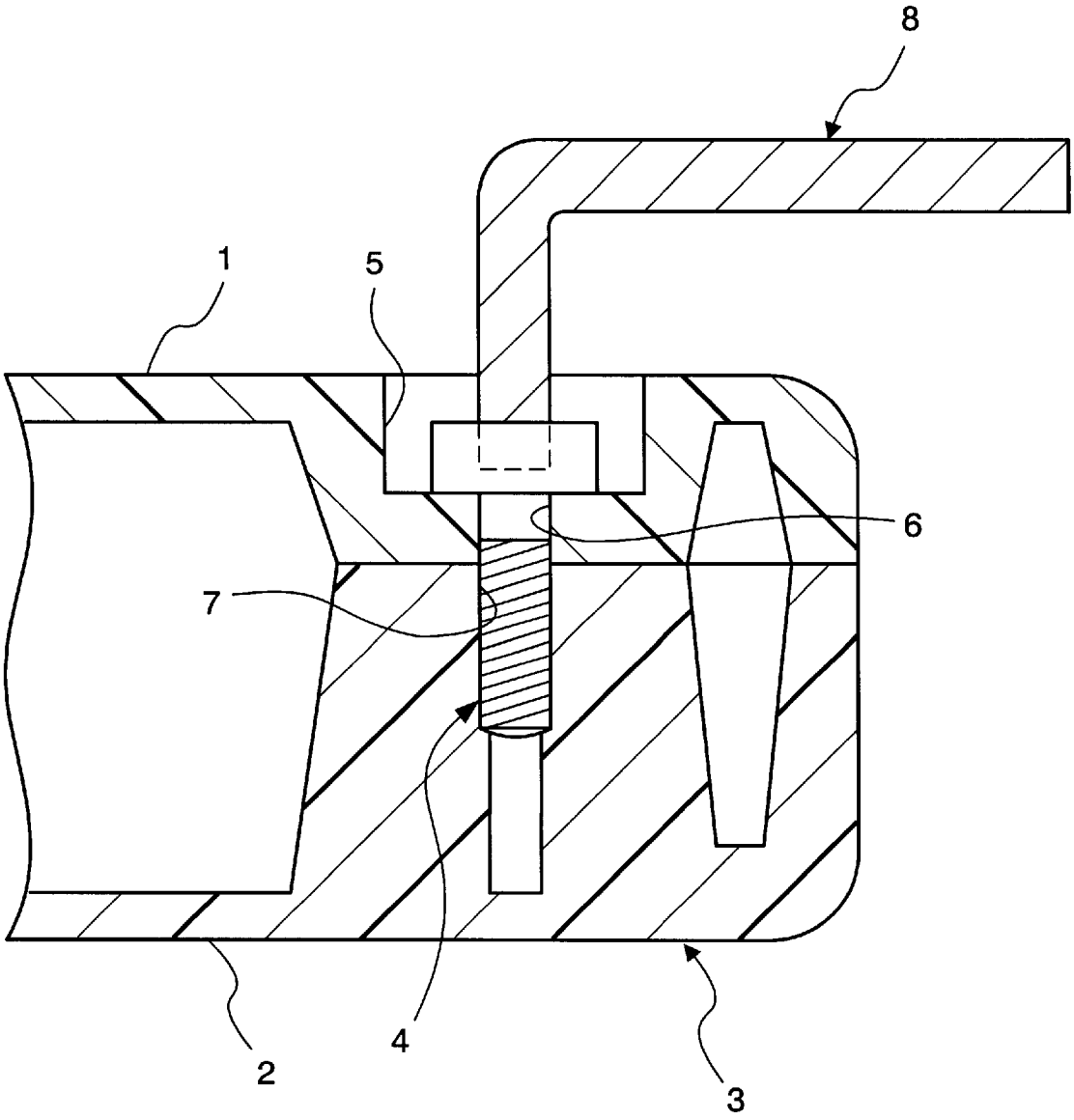
FIG. 6 (PRIOR ART)
FIG. 6 is a cross-sectional view showing an important portion of the fastening structure shown in FIG. 5.

The fastening torque control tool 17 related to the embodiment comprises: a base portion 17*a* which is fixed to the head portion 13*a* of the bolt 13 in a way that restricts the relative rotation around the axis 27; and an operational portion 17*b* to which a fastening instrument 18 to turn the bolt 13 is fixed in a way that restricts the relative rotation around the axis 27. A separating portion 17*c*, for separating the operational portion 17*b* from the base portion 17*a* when the fastening torque applied to the operational portion 17*b* reaches a predetermined value, is formed between the base portion 17*a* and the operational portion 17*b*, in a basic way (as shown in FIG. 4).

Describing the details of these portions, the fastening torque control tool 17 is made of a synthetic resin. A hexagonal socket 19 having the same shape as the sectional shape of the head portion 13*a* of the bolt 13 is formed on the base portion 17*a* thereof. The correspondence in the shape of the hexagonal socket 19 and the head portion 13*a* allows the hexagonal socket 19 to engage the head portion 13*a* of the bolt 13.

In this embodiment, the hexagonal socket 19 is formed in the same shape as the head portion 13*a* but is a little smaller than the head portion 13*a*; when fixing the base portion 17*a* into the head portion 13*a*, the base portion 17*a* is fixed to the head portion 13*a* in a pressed way. Therefore, when fixing the fastening torque control tool 17 onto the bolt 13, it is stuck fast to the bolt 13.

A hexagonal socket 20 for fixing the fastening instrument 18 is formed on the operational portion 17*b* when a hexagonal wrench is used as the fastening instrument 18 as illustrated in FIG. 1; this fixes the fastening instrument 18 into the operational portion 17*b* in a way that restricts the relative rotation of the operational portion 17*b*.

Further, in this embodiment, the separating portion 17*c* is formed by making thin the continued portion from the base portion 17*a* and the operational portion 17*b*; the thin separating portion 17*c* acts as a stress-concentrating portion.

This thin separating portion 17*c* is formed either all around the circumference of the operational portion 17*b* or at several positions around the circumference of the operational portion 17*b* at some interval 26. The shape of the thin separating portion 17*c* is properly established in consideration of: (a) the defined fastening torque necessary for separating the base portion 17*a* from the operational portion 17*b*; (b) the thickness of the operational portion 17*b*; and (c) the material of the fastening torque control tool 17.

Namely, it should be a shape causing a breaking stress to the separating portion 17*c* when the fastening torque reaches the predetermined value, as mentioned above.

Figure 3:
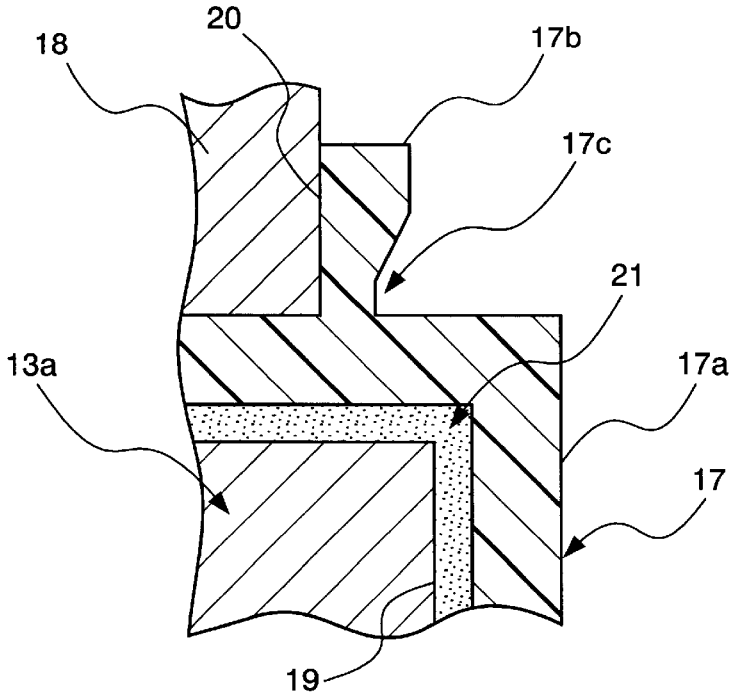
FIG. 3 is a cross-sectional view showing the fastening structure of a case in the state before fastening, with one portion omitted therefrom, according to one embodiment of the present invention.

While, colorant 21 is applied to the inside of the hexagonal socket 19 of the base portion 17*a* into a predetermined thickness, as illustrated in FIG. 3, this colorant 21 is attached to the surface of the head portion 13*a* when fixing the base portion 17*a* to the head portion 13*a* of the bolt 13, which works as a marking function in this embodiment. For example, even if the fastening torque control tool 17 is removed away after completing fastening of the bolt 13, checking the color attached to the head portion 13*a* makes it possible to confirm the fastening has been performed by using the fastening torque control tool 17.

The function of the embodiment, having the structure above described, will now be described.

After fixing the base portion 17*a* of the fastening torque control tool 17 into the head portion 13*a* of the bolt 13 to hold fast, the fastening instrument 18 is fixed into the hexagonal socket 20 of the operational portion 17*b* of the fastening torque control tool 17.

Thus, the screw portion 13*b* of the bolt 13 is inserted into the tapped hole 16 of the bottom box 11 via the concave portion 14 and the through hole 15 on the top box 10, and the bolt 13 is rotated by the fastening instrument 18 through the fastening torque control tool 17, thereby screwing the bolt 13 to the bottom box 11.

If this rotation of the bolt 13 is continued, the top box 10 will be connected to the bottom box 11 by a predetermined pressure and the fastening torque applied by the fastening instrument 18 will be increased.

When the fastening torque reaches a predetermined value, the stress caused in the separating portion 17*c* of the fastening torque control tool 17 reaches the breaking stress; as a result, the operational portion 17*b*, into which the fastening instrument 18 is fixed, is separated from the base portion 17*a*.

Here, as the base portion 17*a* is attached to the head portion 13*a* of the bolt 13, the base portion 17*a* is left on the head portion 13*a* of the bolt 13 even after the operational portion 17*b* is separated. Therefore, by confirming the presence of the base portion 17*a*, it is possible to confirm easily and surely that the fastening has been performed by the predetermined fastening torque at the fastening work time.

Further, in this embodiment, since the colorant 21 is applied to the base portion 17*a*, even if the base portion 17*a* is removed for some reason, the marking caused by the colorant 21 left behind on the head portion 13*a* of the bolt 13 makes it possible to confirm that the fastening has been performed by the above-mentioned predetermined fastening torque.

As mentioned above, according to this embodiment, it is possible to perform the fastening by a constant fastening torque and confirm the fastening torque even after the fastening work.

Accordingly, whether the fastening work has been completed well or not can be determined even after the fastening work is completed.

Each shape and measure of each component as shown in this embodiment is only one example, and it may be changed depending on various requirements.

For example, although the base portion 17*a* is pressed onto the head portion 13*a* in this embodiment (as a means for attaching the base portion 17*a* to the head portion 13*a* of the bolt 13), an adhesive agent can be used to attach the base portion 17*a* to the head portion 13*a*, thereby attaching both by using the adhesive power of the adhesive agent.

Although the description has been made, by way of example, with respect to a structure having a hexagonal socket 19 on the base portion 17*a* into which head portion 13*a* of the bolt 13 is fixed, it is also possible to use a protruding portion of a hexagonal pole, extending from the base portion 17*a*, which is to be fixed into a hexagonal hole formed on the head cap screw; the shape of the socket in the head cap screw would be changed to correspond to the shape of the fastening device to be used.

This change in the shape is properly applied also to the operational portion 17*b* depending on the shape of the fastening instrument 18.

As above-described, it is possible to perform the fastening with a constant fastening torque and to confirm the fastening torque even after the fastening work is completed.

Therefore, whether the fastening work has been done well or not can be verified even after the fastening work.

Although the invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above, rather, it should be interpreted to include all possible embodiments which can be embodied within a scope encompassed by the features set out in the appended claims, and equivalents thereof.

What is claimed is:

1. A fastening torque control tool for use with a fastening instrument to fasten a fastening device, the tool comprising:

a base portion which is adapted to be fixed onto a head portion of the fastening device in a way that restricts relative rotation around the fastening device's axis; and an operational portion, which is integrally provided with said base portion by a separating portion and along the axis, which is adapted to be connected to the fastening instrument which is used to turn the fastening device, and which is adapted to be fixed to the fastening instrument in a way that restricts relative rotation around the axis, wherein said separating portion separates said operational portion from said base portion when a fastening torque applied to said operational portion reaches a predetermined value, and wherein said base portion is provided with a marking function for marking the fastening device when said base portion is fixed onto the fastening device.

2. A fastening torque control tool for use with a fastening instrument to fasten a fastening device, the tool comprising:

a base portion which is adapted to be fixed onto a head portion of the fastening device in a way that restricts relative rotation around the fastening device's axis; and an operational portion, which is integrally provided with said base portion by a separating portion and along the axis, which is adapted to be connected to the fastening instrument which is used to turn the fastening device, and which is adapted to be fixed to the fastening instrument in a way that restricts relative rotation around the axis, wherein said separating portion separates said operational portion from said base portion when a fastening torque applied to said operational portion reaches a predetermined value, wherein said base portion is provided with a marking function for marking the fastening device when said base portion is fixed onto the fastening device, and wherein said separating portion is formed by making thin a connected portion which connects said operational portion and said base portion.

3. A fastening torque control tool for use with a fastening instrument to fasten a fastening device, the tool comprising:

a base portion which is adapted to be fixed onto a head portion of the fastening device in a way that restricts relative rotation around the fastening device's axis; and an operational portion, which is integrally provided with said base portion by a separating portion and along the axis, which is adapted to be connected to the fastening instrument which is used to turn the fastening device, and which is adapted to be fixed to the fastening instrument in a way that restricts relative rotation around the axis, wherein said separating portion separates said operational portion from said base portion when a fastening torque applied to said operational portion reaches a predetermined value, wherein said base portion is provided with a marking function for marking the fastening device when said base portion is fixed onto the fastening device, and wherein said base portion is adapted to be attached to the head portion of the fastening device when said operational portion is separated from said base portion.

4. A fastening torque control tool for use with a fastening instrument to fasten a fastening device, the tool comprising:

a base portion which is adapted to be fixed onto a head portion of the fastening device in a way that restricts relative rotation around the fastening device's axis; and an operational portion, which is integrally provided with said base portion by a separating portion and along the axis, which is adapted to be connected to the fastening instrument which is used to turn the fastening device, and which is adapted to be fixed to the fastening instrument in a way that restricts relative rotation around the axis, wherein said separating portion separates said operational portion from said base portion when a fastening torque applied to said operational portion reaches a predetermined value, wherein said base portion is provided with a marking function for marking the fastening device when said base portion is fixed onto the fastening device, and wherein the marking function is executed by applying colorant to a connected surface of said base portion which is adapted to engage said fastening device and transferring the colorant to the head of the fastening device when said base portion is fixed onto the head of the fastening device.

* * * * *